US006239545B1

(12) United States Patent
Van de Meerakker

(10) Patent No.: US 6,239,545 B1
(45) Date of Patent: May 29, 2001

(54) PICTURE DISPLAY DEVICE WITH PICTURE BALANCE CORRECTION SYSTEM

(75) Inventor: Jacobus J. M. Van de Meerakker, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/163,537

(22) Filed: Sep. 30, 1998

(30) Foreign Application Priority Data

Oct. 16, 1997 (EP) ..... 97203238

(51) Int. Cl.[7] ..... H01J 29/70
(52) U.S. Cl. ..... 313/440; 313/441
(58) Field of Search ..... 313/440, 441, 313/442

(56) References Cited

U.S. PATENT DOCUMENTS 5,105,128 * 4/1992 Choi ..... 315/382
5,523,658 * 6/1996 Fukuma et al. ..... 315/368.19
5,798,606 * 8/1998 Koga et al. ..... 313/440

OTHER PUBLICATIONS

"Philips Technisch Tijdschrift" (Philips Technical Review), vol. 39, No. 6/7, p. 157, Fig. 6 No Date.

* cited by examiner

*Primary Examiner*—Nimeshkumar D. Patel
*Assistant Examiner*—Todd Reed Hopper

(57) ABSTRACT

Picture display device comprising a picture balance correction system with a picture balance potentiometer. The system has a synthetic material support, with a wall of the housing of the potentiometer forming part of this support. The cap of the housing and the shaft of the potentiometer may be manufactured in one piece. The connections with the other parts of the picture display device are established by a lead-frame which is secured against the support or around which the support is molded.

19 Claims, 9 Drawing Sheets

PICTURE DISPLAY DEVICE WITH PICTURE BALANCE CORRECTION SYSTEM

BACKGROUND OF THE INVENTION

The invention relates to a picture display device comprising a cathode ray tube which is provided with a deflection unit having deflection coils and a picture balance correction system with a potentiometer with which the picture balance error can be reduced. The invention also relates to a deflection unit and to a picture balance correction system.

A cathode ray tube is suitable as a pick-up tube or a display tube but may be alternatively applied in apparatus for Auger spectroscopy, electron microscopy and electron lithography.

A cathode ray tube for a monochrome display device, for example a television or monitor, has a glass envelope which is composed of a screen and a cone. The widest side of the cone is secured to the screen. Its narrowest side terminates in a tubular end having a substantially circular cross-section, which end is referred to as the neck. The screen is provided with a display screen consisting of a phosphor layer. The tubular end accommodates an electron gun which emits an electron beam during operation. This beam can be sent to a given location on the display screen by means of deflection coils which generate a given magnetic field.

The display screen is activated by scanning the electron beam alongside it, the beam being modulated by a video signal. This video signal ensures that the phosphor is excited in accordance with such a pattern that its luminescence produces an image. When many electrons land on a pixel during the excitation time of this pixel, the image lights up more brightly. The video signal is applied to the cathode via electric current conductors.

There are many pixels per surface unit. Moreover, the pixels are excited one after the other within a very short time. The viewer thereby experiences a moving image from a normal viewing distance.

In a color display device, for example a color television or a color monitor, each pixel consists of three phosphor elements each luminescing in a different primary color. As it were, there are three uniform regular patterns on the display screen, each pattern having a different luminescence color. Instead of one electron beam, three electron beams emitted by three different cathodes in the color electron gun are scanned along the screen during operation. Each of these three beams excites the pixels with a given luminescence color. Since the phosphor elements of a pixel are located close together, the viewer experiences them as a single element instead of separate elements. The color which is experienced is a mixed color of the three elements. By exciting each element with a given intensity, the viewer experiences a given color. For example, if the red element and the blue element are fully excited and the green element is minimally excited, the viewer will experience the mixed color of purple. Moreover, similarly as for a monochrome cathode ray tube, the pixels are located so close together that the viewer does not see them separately from a normal viewing distance. This produces a color image.

During the production of a picture display device, a deflection unit is placed on the cathode ray tube. This unit comprises a field deflection coil and a line deflection coil. With these coils, the deflection of the electrons emitted by the electron gun towards the desired location on the screen is ensured during operation of the picture display device. The field deflection coil deflects electrons in the vertical direction and the line deflection coil deflects electrons in the horizontal direction. When the picture display device leaves the production line, it is checked how the electron beams behave during operation. In most picture display devices, these beams do not initially land on the correct location on the display screen. To improve the landing, a number of different corrections can be applied. Different correction methods are suitable for each type of landing error. To reduce deviations in the vertical direction on the vertical axis, a potentiometer is used. Said type of deviation is referred to as picture balance error and the potentiometer is therefore referred to as picture balance potentiometer. The ratio between the currents through the two field deflection coil halves can be controlled by means of this potentiometer. In this way, the picture balance error can be corrected at zero. A conventional potentiometer comprises a resistor which is placed in a housing consisting of a metal cap and a synthetic material base. An insulation ring is arranged between the resistor and the housing. The housing also accommodates a shaft to which a wiper is secured which makes electrically conducting contact with the resistor and can be displaced. Dependent on the position where the wiper touches the resistor, it receives a different voltage. A contact ring leading the picked-up voltage to the exterior is present between the wiper and the base.

Usually, a picture balance potentiometer on a PCB (printed circuit board) is secured to the deflection unit. The PCB is provided with conducting patterns which extend towards pins to which the connections with the field deflection coil are sealed. Such a construction is shown in, for example FIG. 6, page 157 of Philips Technisch Tijdschrift (Philips Technical Review) vol. 39, no. 6/7. The deflection unit pictured at the bottom right in this Figure shows a PCB on the left-hand side with a potentiometer secured to it (in a cylindrical cap having a circular cross-section).

Said construction is, however, expensive and harmful to the environment. The use of a PCB is not without any risk either. If it were overheated, toxic substances would be released. Moreover, a PCB may easily break.

BRIEF SUMMARY OF THE INVENTION

It is an object of the invention to provide a picture display device provided with an inexpensive, safe and environmentally harmless picture balance correction system. To this end, the picture display device according to the invention is characterized in that the picture balance correction system is provided with a synthetic material support comprising at least a part of the housing of the potentiometer. Further aspects of the invention provide a deflection unit and a picture balance correction system having such a support. Advantageous embodiments are defined by the dependent claims.

If the support already comprises a part of the housing of the potentiometer, the metal cap can be dispensed with. The result is that the insulation ring is also superfluous. This leads to a reduction of costs. The thermoplastic material is much safer and environmentally more favorable than a PCB. A great improvement is thus also obtained in this respect.

In accordance with a preferred embodiment, the picture balance correction system comprises a metal lead-frame which is secured to the support. The fixation can be realized by having projecting pins of the support extend through apertures of the lead-frame and by subsequently sealing the tip. This has the advantage that its fixation can be realized rapidly. Another way of fixation is a method in which metal tubular rivets are riveted through corresponding apertures in the lead-frame and the support. This has the advantage that the fixation is extra strong. Preferably, the rivets are part of the lead-frame and deep-drawn from this frame. This simplifies the production and reduces the costs.

In accordance with a further, advantageous embodiment, the picture balance correction system comprises a metal lead-frame around which the synthetic material is molded. The lead-frame provides the electrically conducting connections with the field deflection coils. This embodiment has the advantage that this correction system can be manufactured very easily. If the lead-frame is provided with a coating which has a very good conductance, such as a silver layer, the contact ring can also be dispensed with. This leads to an extra reduction of costs.

The housing of the potentiometer is usually cylindrical. However, instead of this shape, a different shape of housing may be used. The resistor which is present in the housing is bent in a different way, dependent on its shape. It is even possible to give the resistor a substantially straight shape. This has the advantage that the space around it can then be utilized more efficiently.

These and other aspects of the invention are apparent from and will be elucidated with reference to the embodiments described hereinafter.

DETAILED DESCRIPTION OF THE INVENTION

Figure 1A:
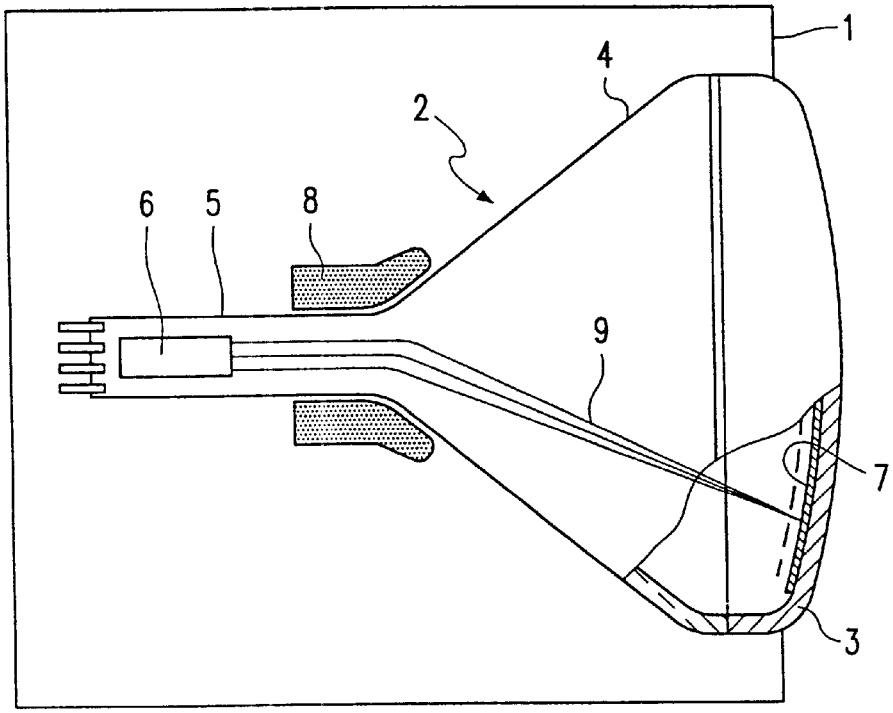
FIG. 1A is a diagrammatic cross-section of a picture display device.
Figure 1B:
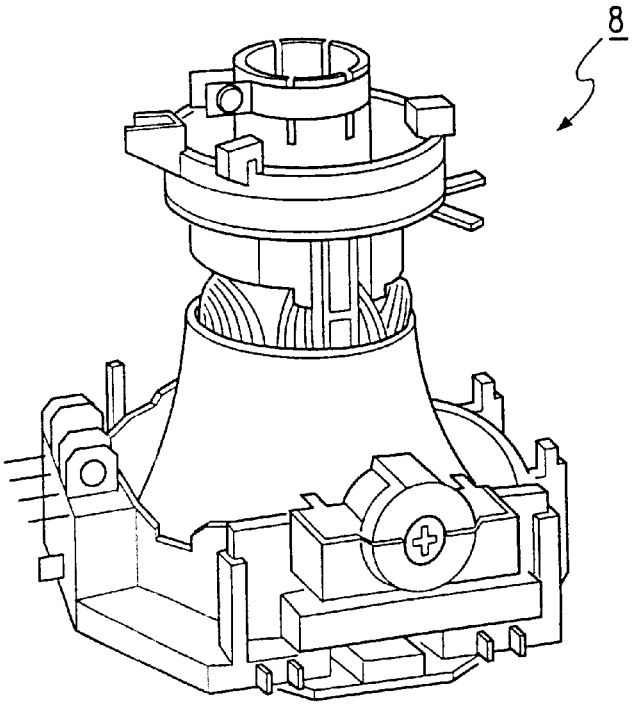
FIG. 1B is a perspective view of a deflection unit of the picture display device of FIG. 1A.

FIG. 1A is a diagrammatic cross-section of a picture display device. A cabinet 1 accommodates a cathode ray tube 2. The cathode ray tube 2 has a glass envelope which is composed of a screen 3 and a cone 4. The reference numeral 5 denotes the neck. The glass envelope accommodates an electron gun 6 and a display screen 7 which consists of a phosphor layer. A deflection unit 8 is arranged around the cathode ray tube. FIG. 1B is a spatial elevational view of this deflection unit 8. When the device is operative, the electron gun 6 emits electrons which, if desired, are deflected by the deflection unit 8, whereafter they land on the desired location on the display screen 7. The electron gun accommodates one or more cathodes (not shown). When a color display device is operated, three electron beams are generated by means of an electron gun with three cathodes. The reference numeral 9 denotes these three electron beams.

Figure 2:
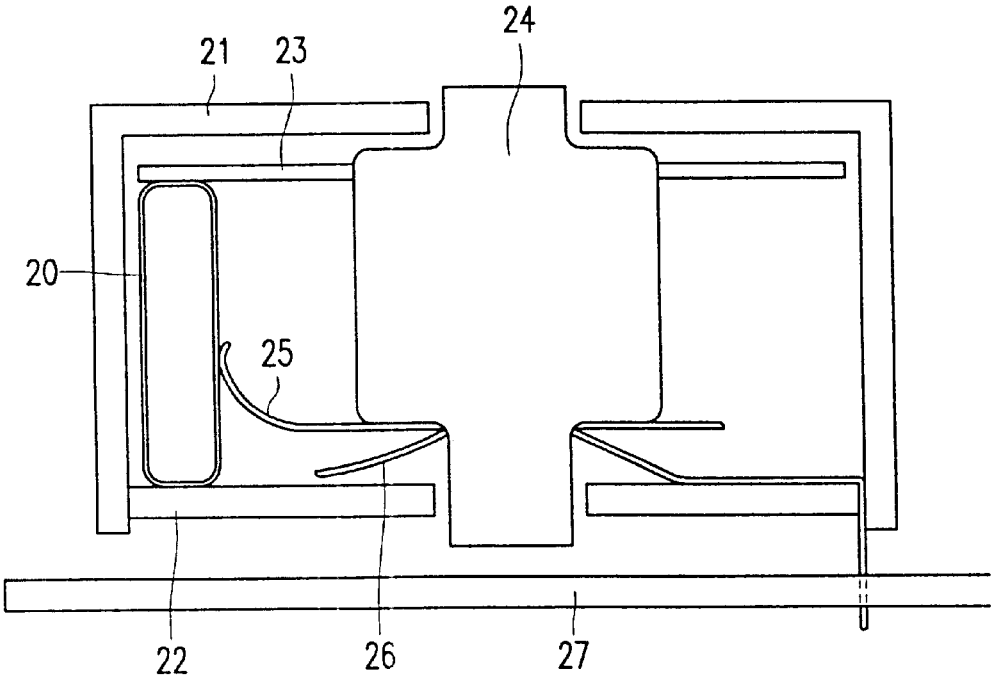
FIG. 2 is a diagrammatic cross-section of a picture balance correction system in accordance with the prior art.

FIG. 2 is a diagrammatic cross-section of a part of a picture balance correction system in accordance with the prior art. Such a system has a PCB (printed circuit board) 27 and a potentiometer. Tracks ensuring the connections between the potentiometer and the rest of the picture display device are present on the PCB 27. These tracks are not shown in the Figure. A conventional potentiometer comprises a resistor 20 which is placed in a housing consisting of a metal cap 21 and a synthetic material base 22. An insulation ring 23 is present between the resistor 20 and the metal cap 21. The housing accommodates a shaft 24 to which a wiper 25 is secured which makes electrically conducting contact with the resistor 20 and can be displaced by rotating the shaft 24. Dependent on the position where the wiper 25 touches the resistor 20, it receives a different voltage. A contact ring 26 leading the picked-up voltage to the exterior, to the PCB (printed circuit board) 27 on which the potentiometer is secured, is present between the wiper 25 and the base 22. The resistor 20 has also two connections via which the voltage is supplied. These connections are not visible in the Figure because they are located in a different plane than the cross-section shown.

Figure 3:
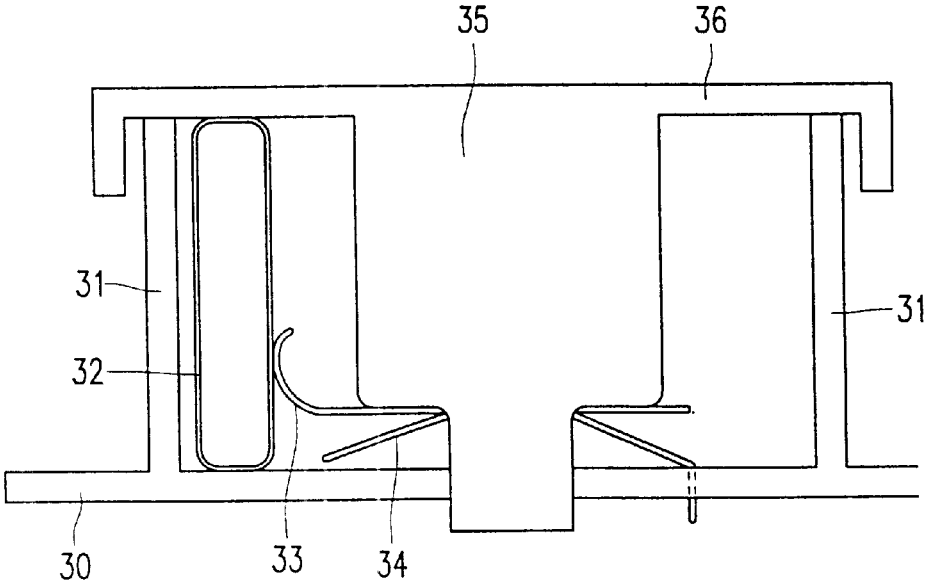
FIG. 3 is a diagrammatic cross-section of an embodiment of a picture balance correction system according to the invention.

FIG. 3 is a diagrammatic cross-section of an embodiment of a picture balance correction system according to the invention. This system comprises, inter alia, a support 30 of a thermoplastic material and a potentiometer. This support 30 also comprises a part of the housing of the potentiometer, namely the cylindrical wall 31. A resistor 32, a wiper 33 and a contact ring 34 are present within this wall. The wiper 33 makes electrically conducting contact with the resistor 32. The voltage picked up from the resistor is applied via the contact ring 34 to the connections on or in the support 30. Displacement of the wiper 33 can be realized by rotating the shaft 35 which, in this case, forms an integral part with the cap 36 of the housing. The number of components of the inventive picture balance correction system is thus reduced with respect to that in the prior art.

The connections between the potentiometer and the rest of the picture display device may be realized in different ways. They may be a lead-frame which is secured to the support. The support may also be molded around the lead-frame. In this case, the support is preferably a thermoplastic material. This can be easily molded.

Figure 4A:
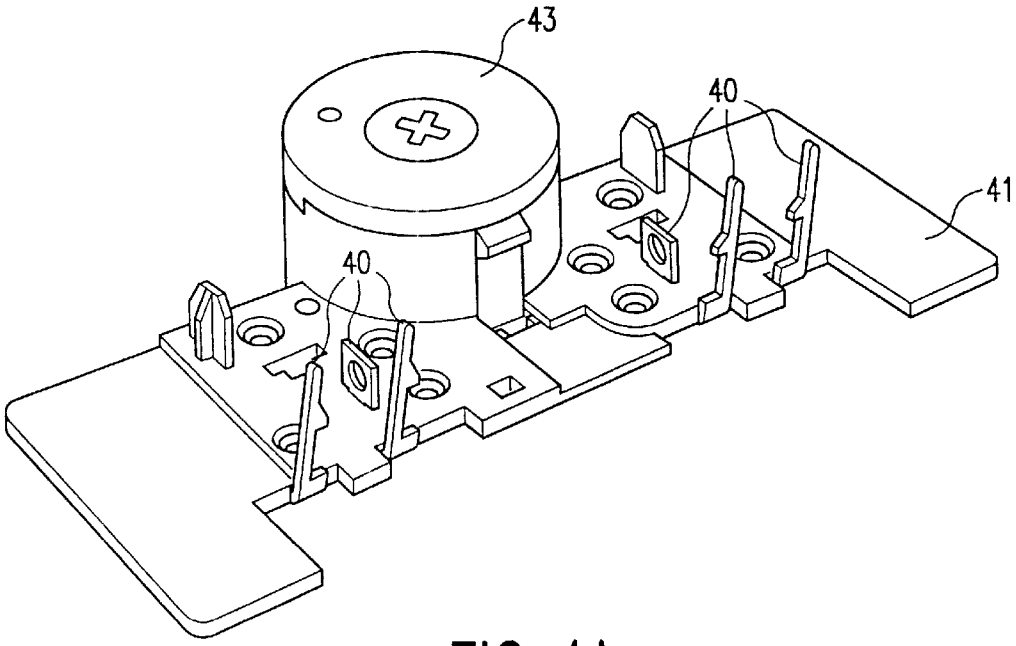
FIG. 4A is a diagrammatic perspective view of the embodiment of a picture balance correction system.
Figure 4B:
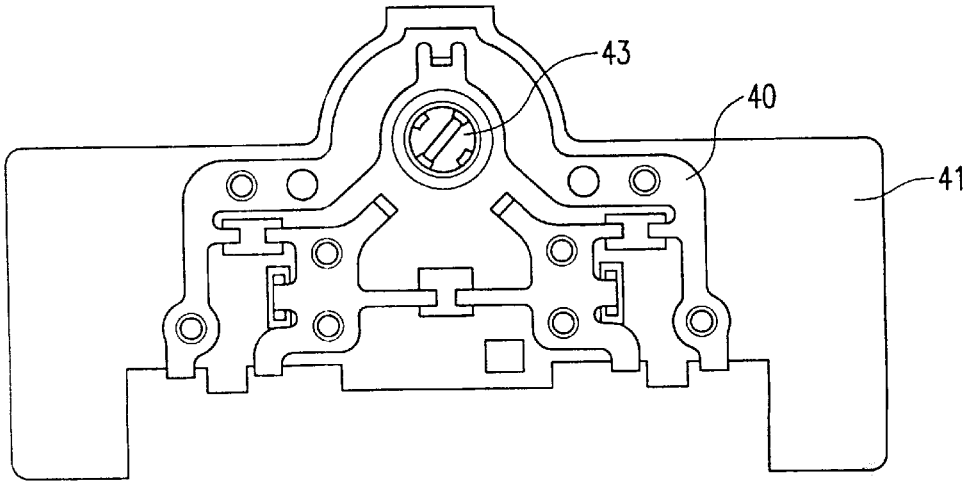
FIG. 4B is a diagrammatic bottom view of the embodiment of a picture balance correction system of FIG. 4A.

FIGS. 4A and 4B are a diagrammatic plan view and a diagrammatic bottom view, respectively, of the picture balance correction system, in which a lead-frame is secured to a support. The Figures show the lead-frame 40, the support 41 and the component 43 in which the shaft and the cap are integrated. In the embodiment shown, the lead-frame is secured to the support by means of rivet joints, in which the tubular rivets are part of the lead-frame.

The lead-frame may be secured to the support in different ways. FIGS. 5, 6 and 7 show a number of possible types of connections.

Figure 5A:
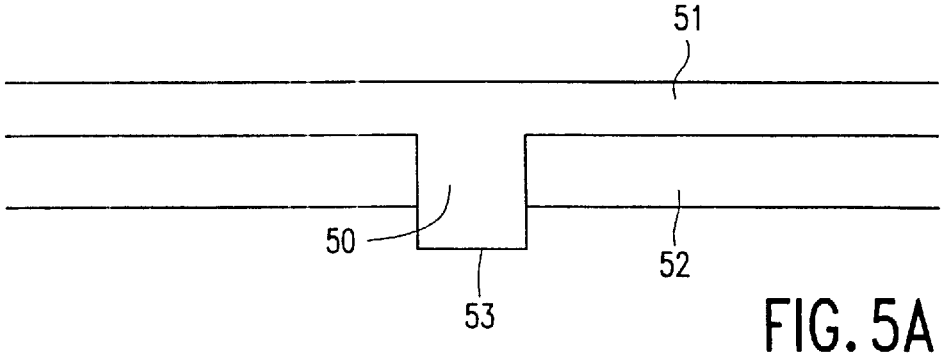
FIG. 5A is a diagrammatic cross-section of an embodiment of a pin connection of the lead-frame and the support, in which the pin is not fixed yet.
Figure 5B:
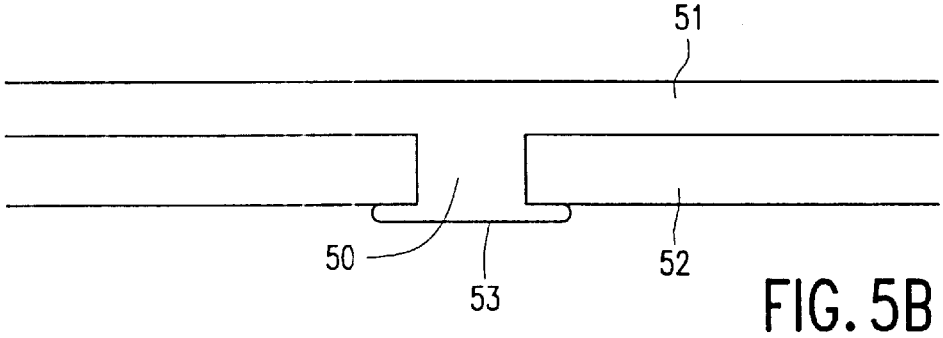
FIG. 5B is a diagrammatic cross-section of the pin connection of FIG. 5A, in which the pin is fixed.

FIG. 5A is a diagrammatic cross-section of an embodiment of a pin connection of the lead-frame and the support, in which the pin is not fixed yet. FIG. 5B is a diagrammatic cross-section of the same embodiment, in which the pin is fixed. The pin 50 forms part of the synthetic material support 51. To establish the connection, the pin 50 is projected through an aperture in the lead-frame 52, whereafter the end 53 of the pin 50 is melted.

Figure 6A:
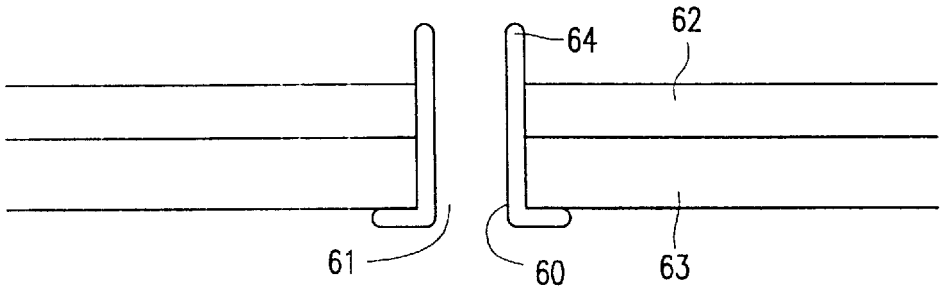
FIG. 6A is a diagrammatic cross-section of an embodiment of a rivet joint of the lead-frame and the support, in which the rivet is not fixed yet.
Figure 6B:
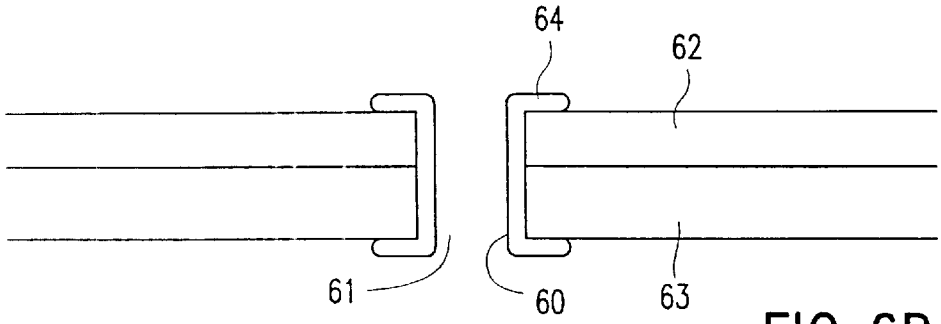
FIG. 6B is a diagrammatic cross-section of the rivet joint of FIG. 6A, in which the rivet is fixed.

FIG. 6A is a diagrammatic cross-section of an embodiment of a rivet joint of the lead-frame and the support, in which the rivet is not fixed yet. FIG. 6B is a diagrammatic cross-section of the same embodiment, in which the rivet is fixed. To establish the connection, a rivet 60 is projected through corresponding apertures 61 in the support 62 and the lead-frame 63. Subsequently, the end 64 is flanged.

Figure 7A:
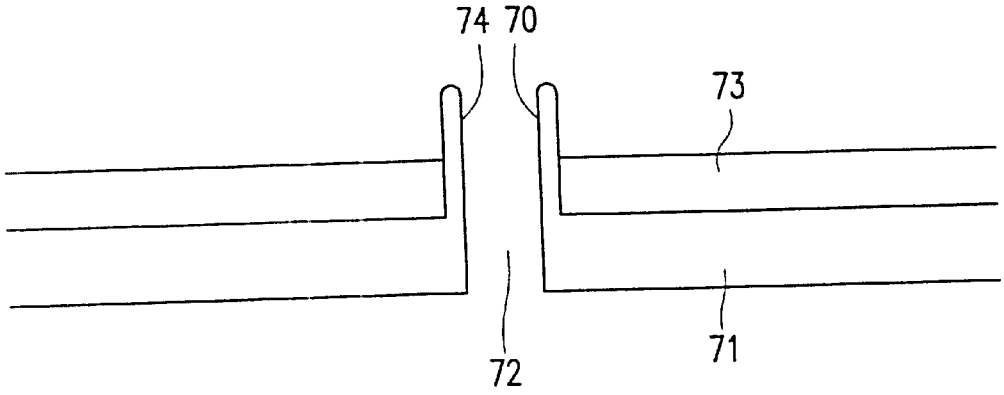
FIG. 7A is a diagrammatic cross-section of an embodiment of a rivet joint of the lead-frame and the support, in which the rivet forms part of the lead-frame and is not fixed yet.
Figure 7B:
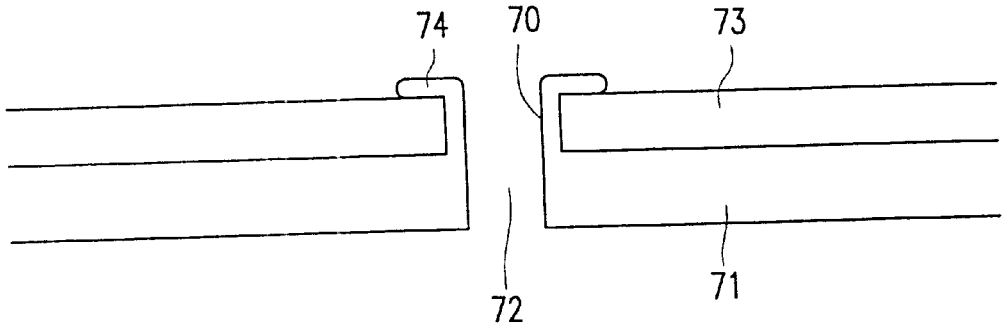
FIG. 7B is a diagrammatic cross-section of the rivet joint of FIG. 7A of the lead frame and the support, in which the rivet forms part of the lead-frame and is fixed.

FIG. 7A is a diagrammatic cross-section of an embodiment of a rivet joint of the lead-frame and the support, in which the rivet is part of the lead-frame and is not fixed yet. FIG. 7B is a diagrammatic cross-section of the same embodiment, in which the rivet is fixed. To establish the connection, the rivet 70, which forms part of the lead-frame 71, is projected through an aperture 72 in the support 73. Subsequently, the end 74 of the rivet is flanged.

Figure 8A:
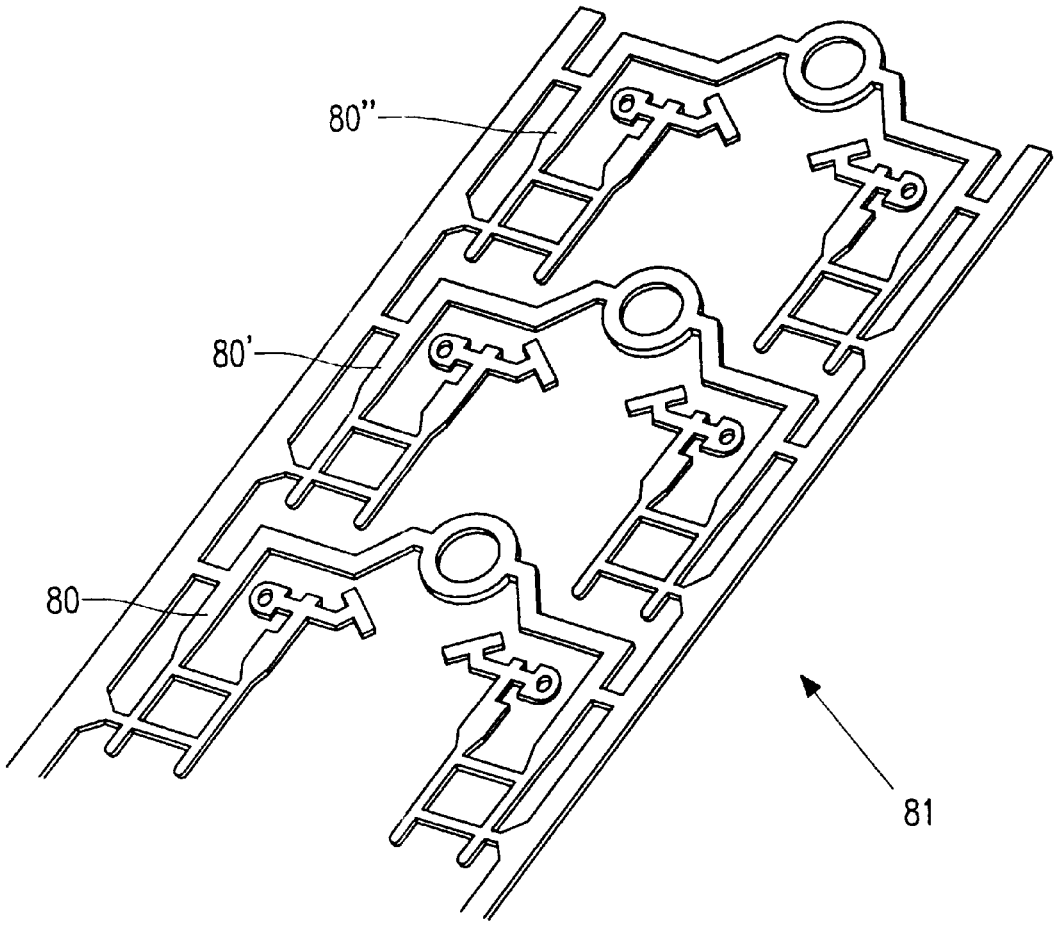
FIG. 8A shows a lead-frame of an embodiment of a picture balance correction system according to the invention.
Figure 8B:
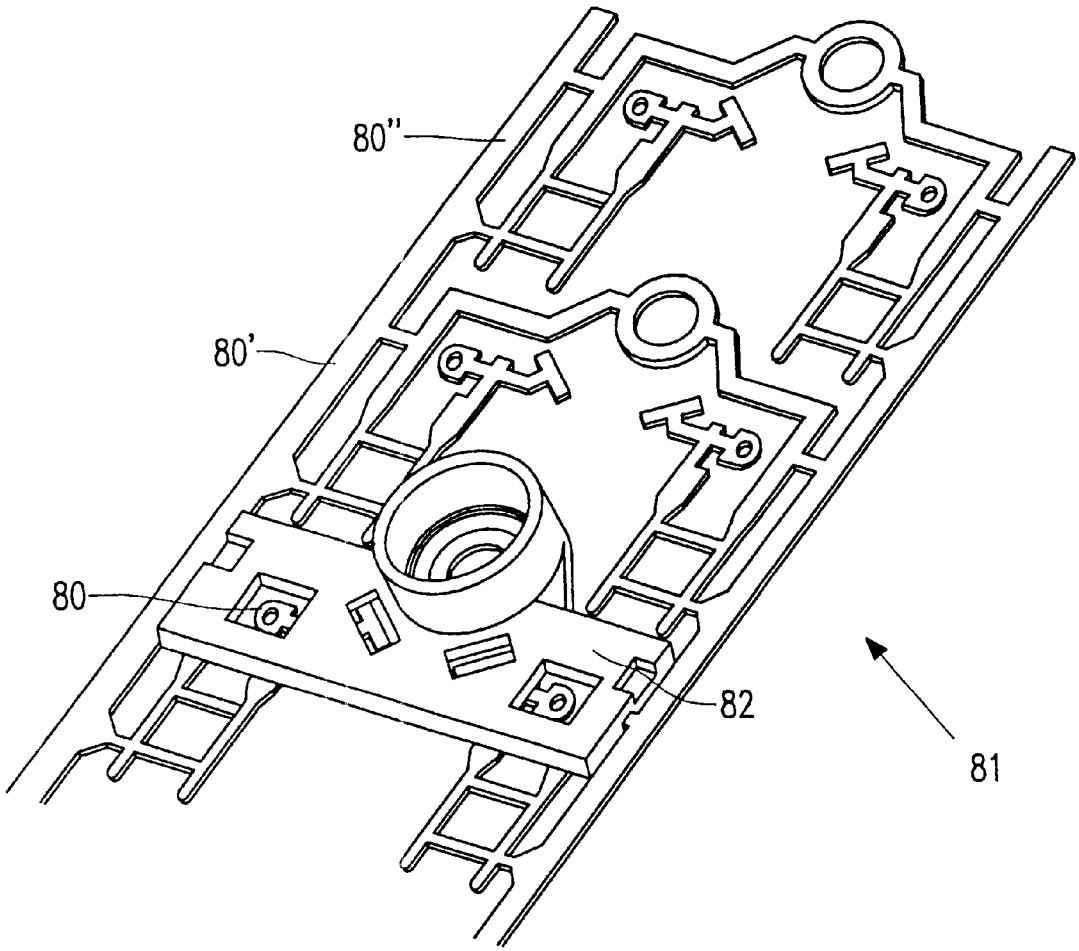
FIG. 8B shows the lead-frame of FIG. 8A, in which a synthetic material support is molded around a unit.
Figure 8C:
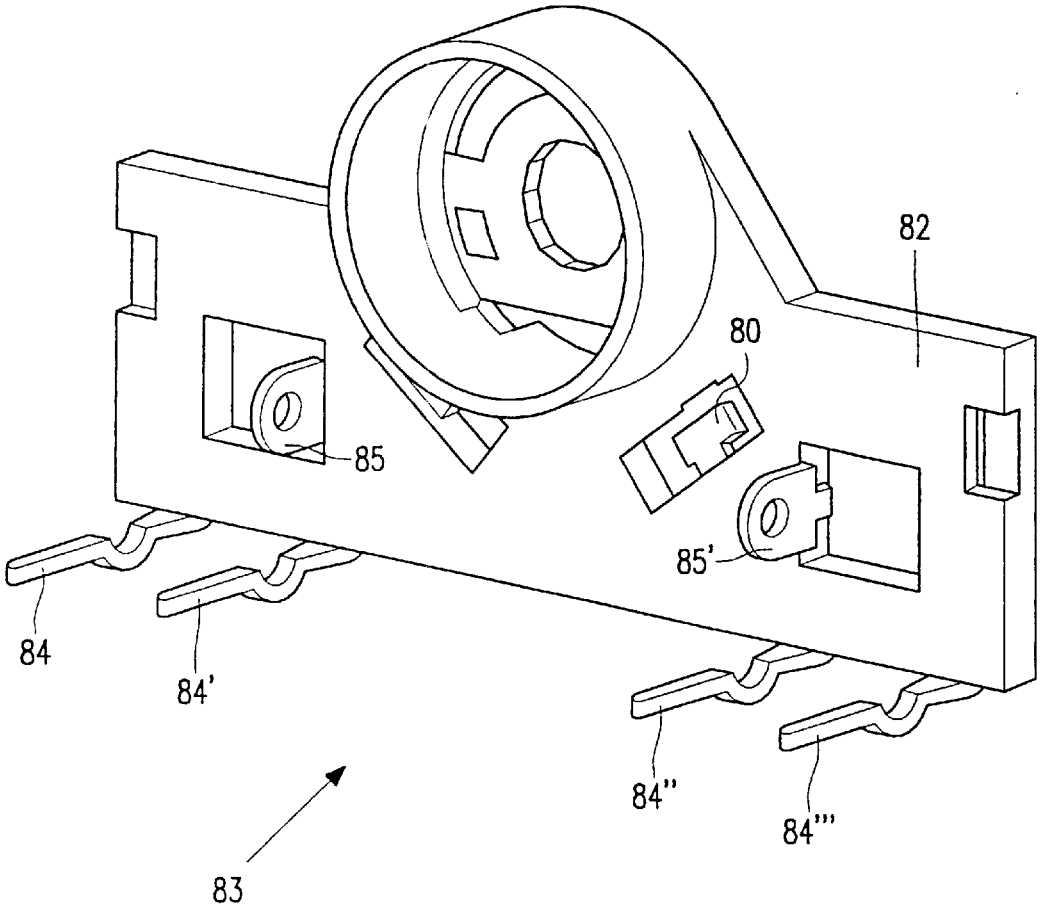
FIG. 8C shows the unit punched from the lead-frame of FIG. 8B, in which the connection pieces are bent.

FIG. 8A shows a lead-frame of an embodiment of a picture balance correction system according to the invention. FIG. 8B shows the lead-frame of FIG. 8A in which a synthetic material support is molded around a unit. FIG. 8C shows the unit punched from the lead-frame of FIG. 8B, in which the connection pieces are bent. It is advantageous to manufacture the lead-frames 80, 80', 80" from a long strip 81. This strip 81 may of course comprise a much larger number than the three lead-frames shown. A synthetic material constituting the support 82 is then molded around a lead-frame 80. Subsequently, the combination 83 of lead-frame 80 and support 82 is punched out. Finally, the connection pins 84, 84', 84", 84''', 85, 85', are bent until they have the desired position.

Figure 9:
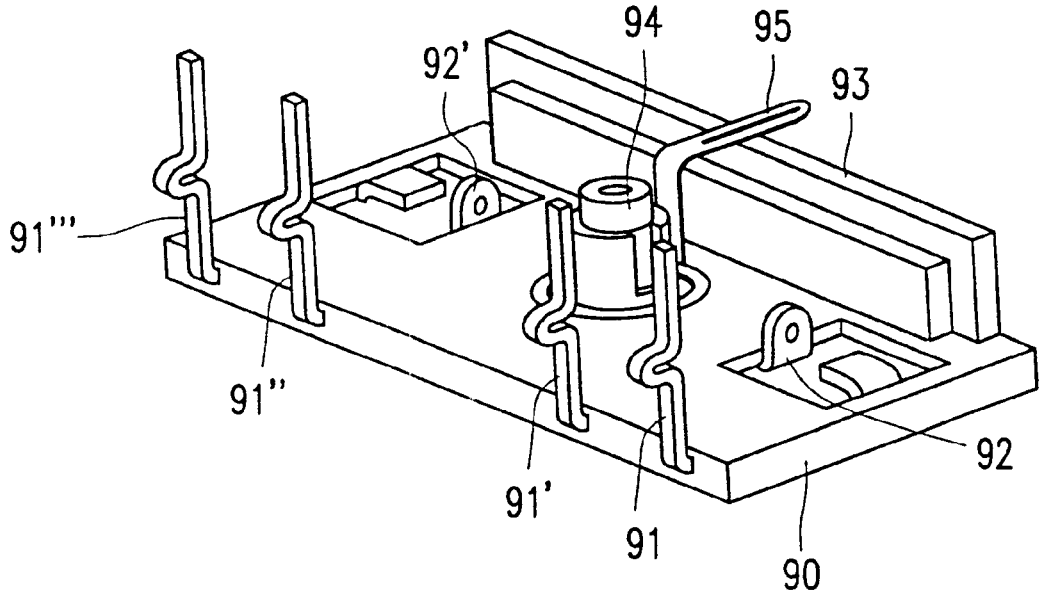
FIG. 9 is a diagrammatic perspective view of an embodiment of a picture balance correction system according to the invention, in which the resistor is substantially straight.

FIG. 9 is a diagrammatic spatial elevational view of an embodiment of a picture balance correction system according to the invention, in which the resistor is substantially straight. The Figure shows the support 90, connection pins 91, 91', 91", 91''', 92, 92' of the lead-frame and a number of components of the potentiometer, namely the resistor 93, the shaft 94 and the wiper 95.

In summary, the invention relates to a picture display device comprising a picture balance correction system with a picture balance potentiometer. The system has a synthetic material support, with a wall of the housing of the potentiometer forming part of this support. The cap of the housing and the shaft of the potentiometer may be manufactured in one piece. The connections with the other parts of the picture display device are established by a lead-frame which is secured against the support or around which the support is molded.

It should be noted that the above-mentioned embodiments illustrate rather than limit the invention, and that those skilled in the art will be able to design many alternative embodiments without departing from the scope of the appended claims. In the claims, the word "comprising" does not exclude the presence of other elements than those listed in the claims.

What is claimed is:

1. A picture display device comprising a cathode ray tube which is provided with a deflection unit having deflection coils and a picture balance correction system secured to the deflection unit, said picture balance correction system comprising a potentiometer with which a picture balance error can be reduced, characterized in that the picture balance correction system is provided with a synthetic material support comprising at least a part of the housing of the potentiometer.

2. A picture display device as claimed in claim 1, characterized in that a lead-frame is secured to the support which lead-frame provides electric connections between the potentiometer and the deflection coils.

3. A picture display device as claimed in. claim 2, characterized in that the lead-frame is secured to the support by means of projections of the support which extend through apertures in the lead-frame and whose heads are flanged by melting.

4. A picture display device as claimed in claim 2, characterized in that the lead-frame is secured to the support by means of tubular rivets which project through corresponding apertures in the support and the lead-frame, whereafter the heads of the rivets are flanged.

5. A picture display device as claimed in claim 2, characterized in that the lead-frame is secured to the support by means of tubular rivets which form part of the lead-frame and extend through apertures in the support, whereafter the heads of the rivets are flanged.

6. A picture display device as claimed in claim 2, characterized in that the electric connections between the potentiometer and the deflection coils are connections to the field coils only.

7. A picture display device as claimed in claim 6, characterized in that said at least a part of the housing of the potentiometer includes a support portion and a cylindrical wall.

8. A picture display device as claimed in claim 7, characterized in that said potentiometer comprises a shaft formed integrally with a cap, the shaft and cap being made of an insulating material.

9. A picture display device as claimed in claim 7, characterized in that the lead-frame is secured to the support by elements which project through apertures in at least one of the support and the lead-frame.

10. A picture display device as claimed in claim 1, characterized in that the support is molded around a lead-frame which ensures the electric connections between the potentiometer and the deflection coils.

11. A picture display device as claimed in claim 1, characterized in that said at least a part of the housing of the potentiometer includes a support portion and a cylindrical wall.

12. A picture display device as claimed in claim 11, characterized in that said potentiometer comprises a shaft formed integrally with a cap, the shaft and cap being made of an insulating material.

13. A deflection unit having deflection coils and a picture balance correction system secured to the deflection unit, said picture balance correction system comprising a potentiometer with which a picture balance error can be reduced, characterized in that the picture balance correction system is provided with a synthetic material support comprising at least a part of the housing of the potentiometer.

14. A deflection unit as claimed in claim 13, characterized in that a lead-frame is secured to the support, said lead-frame providing electric connections between the potentiometer and the deflection coils.

15. A deflection unit as claimed in claim 14, characterized in that the electric connections between the potentiometer and the deflection coils are connections to the field coils only.

16. A deflection unit as claimed in claim 15, characterized in that said at least a part of the housing of the potentiometer includes a support portion and a cylindrical wall.

17. A deflection unit as claimed in claim 15, characterized in that the lead-frame is secured to the support by elements which project through apertures in at least one of the support and the lead-frame.

18. A deflection unit as claimed in claim 16, characterized in that said potentiometer comprises a shaft formed integrally with a cap, the shaft and cap being made of an insulating material.

19. A picture balance correction system with a potentiometer with which a picture balance error in the vertical direction can be reduced, said potentiometer being connected electrically to a field deflection coil, characterized in that the picture balance correction system is provided with a synthetic material support comprising at least a part of the housing of the potentiometer.

* * * * *